US011235358B2

(12) United States Patent
He

(10) Patent No.: US 11,235,358 B2
(45) Date of Patent: Feb. 1, 2022

(54) BLOWER CLEANER WITH LIGHT

(71) Applicant: Yandong He, Foshan (CN)

(72) Inventor: Yandong He, Foshan (CN)

( * ) Notice: Subject to any disclaimer, the term of this patent is extended or adjusted under 35 U.S.C. 154(b) by 0 days.

(21) Appl. No.: 17/020,861

(22) Filed: Sep. 15, 2020

(65) Prior Publication Data

US 2021/0331216 A1 Oct. 28, 2021

(30) Foreign Application Priority Data

Apr. 28, 2020 (CN) ..... 202020674590.7

(51) Int. Cl.

| | |
|---|---|
| ***B08B 5/02*** | (2006.01) |
| ***B08B 9/093*** | (2006.01) |
| ***B08B 13/00*** | (2006.01) |
| ***F21V 23/04*** | (2006.01) |
| ***F21V 33/00*** | (2006.01) |
| ***F21V 19/00*** | (2006.01) |
| ***A47L 9/30*** | (2006.01) |
| ***F21Y 115/10*** | (2016.01) |

(52) U.S. Cl.

CPC ..... *B08B 5/02* (2013.01); *A47L 9/30* (2013.01); *B08B 9/093* (2013.01); *B08B 13/00* (2013.01); *F21V 19/0045* (2013.01); *F21V 23/04* (2013.01); *F21V 33/0044* (2013.01); *B08B 2209/08* (2013.01); *F21Y 2115/10* (2016.08)

(58) Field of Classification Search

CPC ..... F21V 33/0044; A47L 9/30; A47L 9/08; B08B 5/02; F24F 13/078

USPC ..... 362/91; 15/324

See application file for complete search history.

(56) References Cited

U.S. PATENT DOCUMENTS

| | | | | |
|---|---|---|---|---|
| 5,575,035 | A * | 11/1996 | Reis | A47L 13/02 15/324 |
| 6,092,260 | A * | 7/2000 | Kai | B05B 7/2435 15/320 |
| 9,335,061 | B2 * | 5/2016 | Avedon | F04D 29/542 |
| 2006/0096057 | A1 * | 5/2006 | Chatfield | A47L 9/2836 15/324 |
| 2008/0301903 | A1 * | 12/2008 | Cunningham | A47L 9/281 15/410 |
| 2013/0247327 | A1 * | 9/2013 | Domingo | A01G 20/47 15/324 |
| 2015/0000070 | A1 * | 1/2015 | Liu | A47L 9/0027 15/330 |
| 2021/0153709 | A1 * | 5/2021 | Luyckx | F21V 23/06 |

* cited by examiner

*Primary Examiner* — William N Harris

(57) ABSTRACT

The present disclosure provides a blower cleaner. The blower cleaner includes a housing and a movement. The housing includes an installation cavity, an air inlet, and an air outlet. The air inlet and the air outlet are communicated with the installation cavity. The movement is arranged in the installation cavity and is arranged between the air inlet and the air outlet. An illuminating light is arranged in the housing. The illuminating light is arranged inside the installation cavity and directly faces the air outlet.

3 Claims, 4 Drawing Sheets

BLOWER CLEANER WITH LIGHT

TECHNICAL FIELD

The present disclosure relates to a field of cleaning equipment technology, and in particular to a blower cleaner with a light.

BACKGROUND

A blower cleaner is a device that generally uses the wind generated by movement to blow away dust and sundries in/on a computer case or other items to achieve cleaning the computer case and other items. In general, conventional blower cleaners only have blower function and do not have a lighting function. When a user needs to blow the dust inside the computer case or other items or blow dust on corners with poor light, the user is unable to determine a position of the dust clearly and is unable to effectively clean the items. Sometimes it is necessary for the user to hold a flashlight and other lighting tools to determine the position of the dust, which is inconvenient. Therefore, it is necessary to improve the blower cleaner in the prior art.

SUMMARY

In view of deficiencies in the prior art, a main purpose of the present disclosure is to provide a blower cleaner with light, which effectively solves a problem of inconvenience caused by the conventional blower cleaner without a lighting function.

To achieve the above object, the present disclosure provides a blower cleaner. The blower cleaner comprises a housing and a movement.

The housing comprises an installation cavity, an air inlet, and an air outlet. The air inlet and the air outlet are communicated with the installation cavity. The movement is arranged in the installation cavity and is arranged between the air inlet and the air outlet. An illuminating light is arranged in the housing. The illuminating light is arranged inside the installation cavity and directly faces the air outlet.

In one embodiment, an installation portion is arranged in the installation cavity, the installation portion comprises a clamping groove. The illuminating light is an LED light board. The LED light board is clamped and fixed on the clamping groove.

In one embodiment, the housing comprises a handle. A control switch is arranged on a front side of the handle. The illuminating light and the movement are electrically connected with the control switch.

In one embodiment, the housing comprises a main body, the handle extends from a rear side of the main body. An air nozzle extends forward and upward from a top portion of the main body. The air outlet is arranged on a front end surface of the air nozzle. The air inlet is arranged on a bottom surface of the main body. The movement is arranged in the main body.

By arranging the illuminating light in the housing and arranging the illuminating light in the installation cavity to directly face the air outlet, when the present disclosure is used, the light generated by the illuminating light emits from the air outlet to accurately illuminate the position to be blown, which is convenient for a user to find out position that needs to be blown and cleaned, so as to effectively blow and clean the items, therefore the user is no need to hold a flashlight and other lighting tools, which brings convenience to the user.

In order to explain structural features and effects of the present disclosure more clearly, the present disclosure will be described in detail below with reference to the drawings and specific embodiments.

10—housing; 11—handle; 12—main body; 13—air nozzle; 101—installation cavity; 102—air inlet; 103—air outlet; 104—installation portion; 105—clamping groove; 20—movement; 30—control switch; 40—illuminating light.

DETAILED DESCRIPTION

Figure 1:
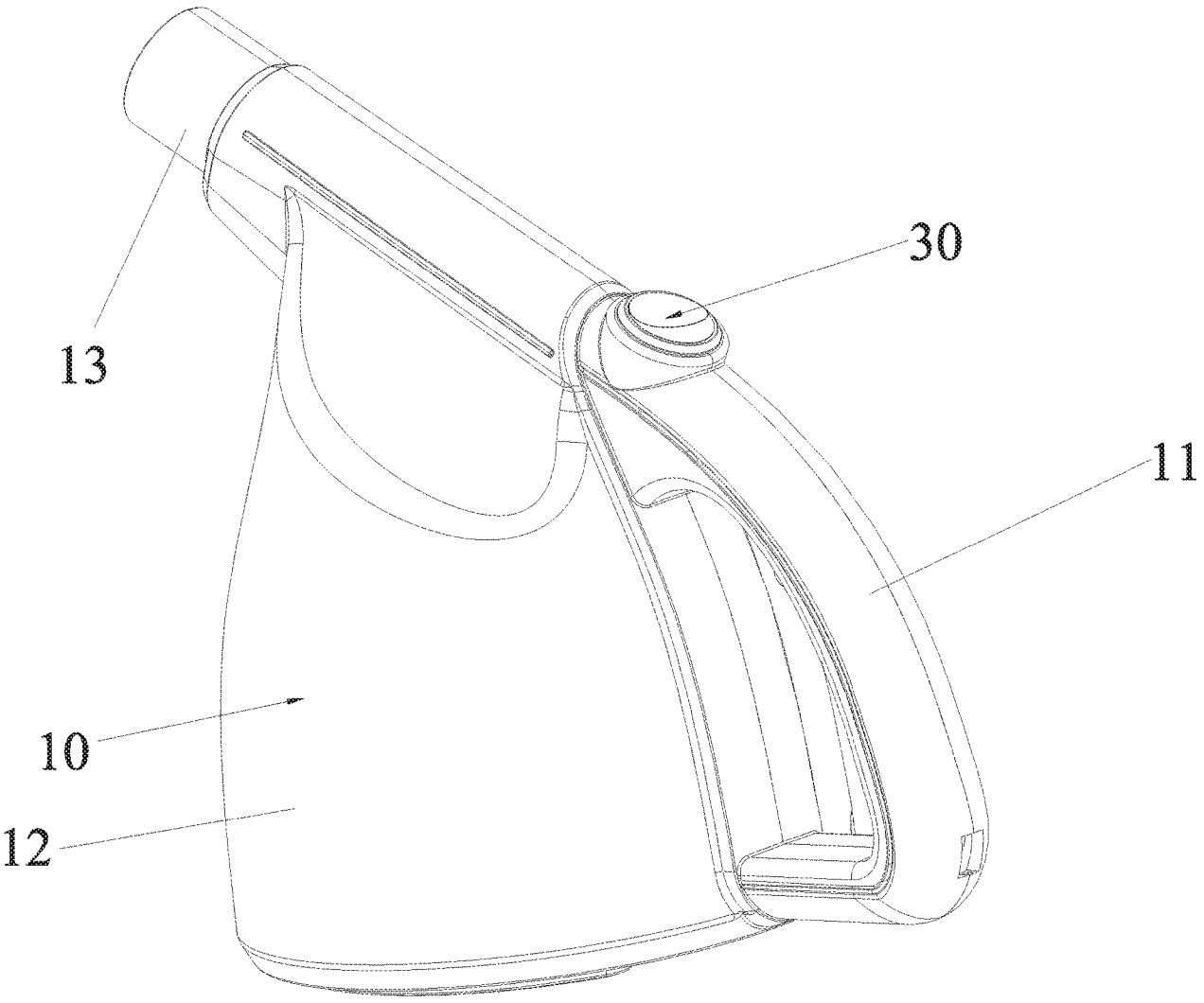
FIG. 1 is a perspective schematic diagram according to one optional embodiment of the present disclosure.
Figure 2:
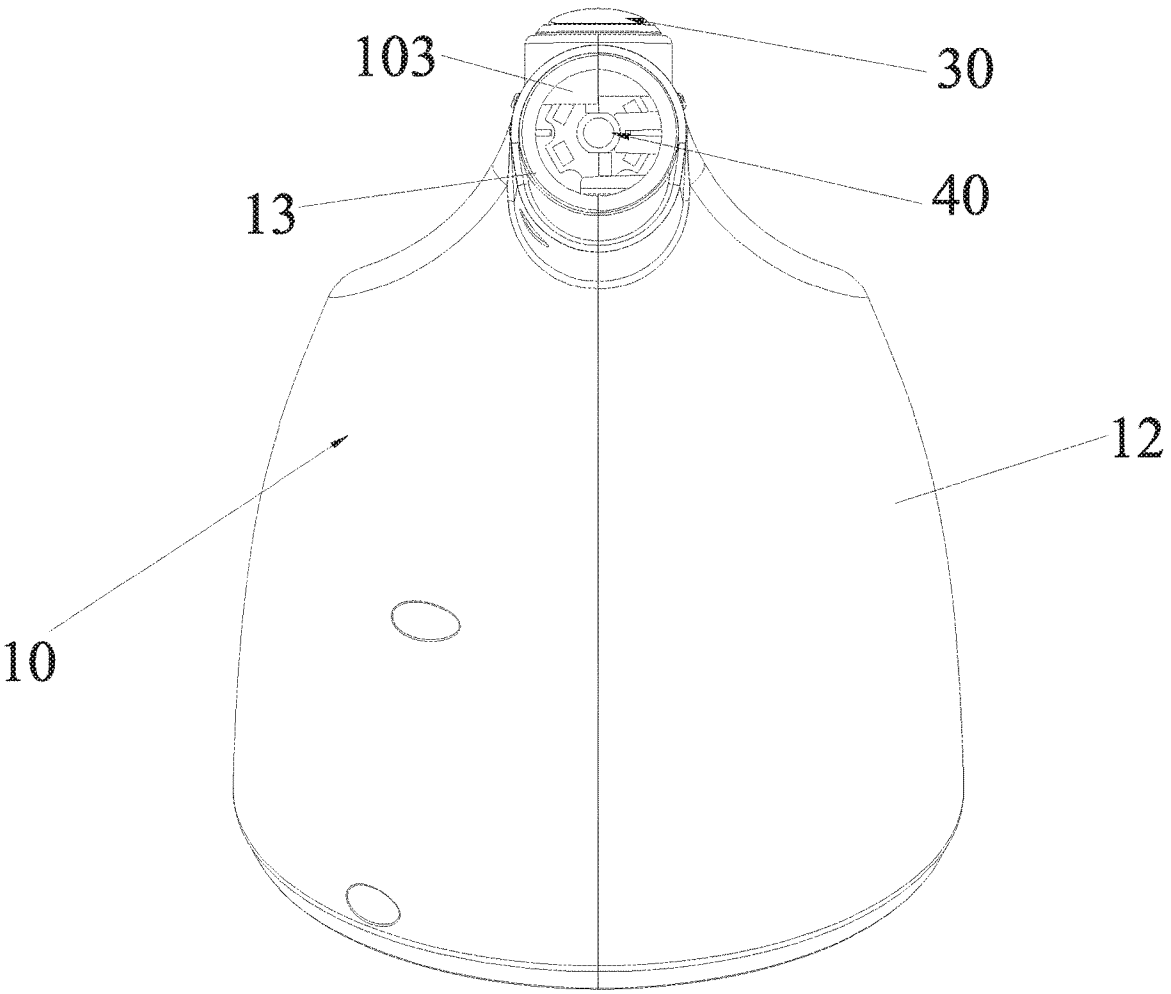
FIG. 2 is a front elevational view according to one optional embodiment of the present disclosure.
Figure 3:
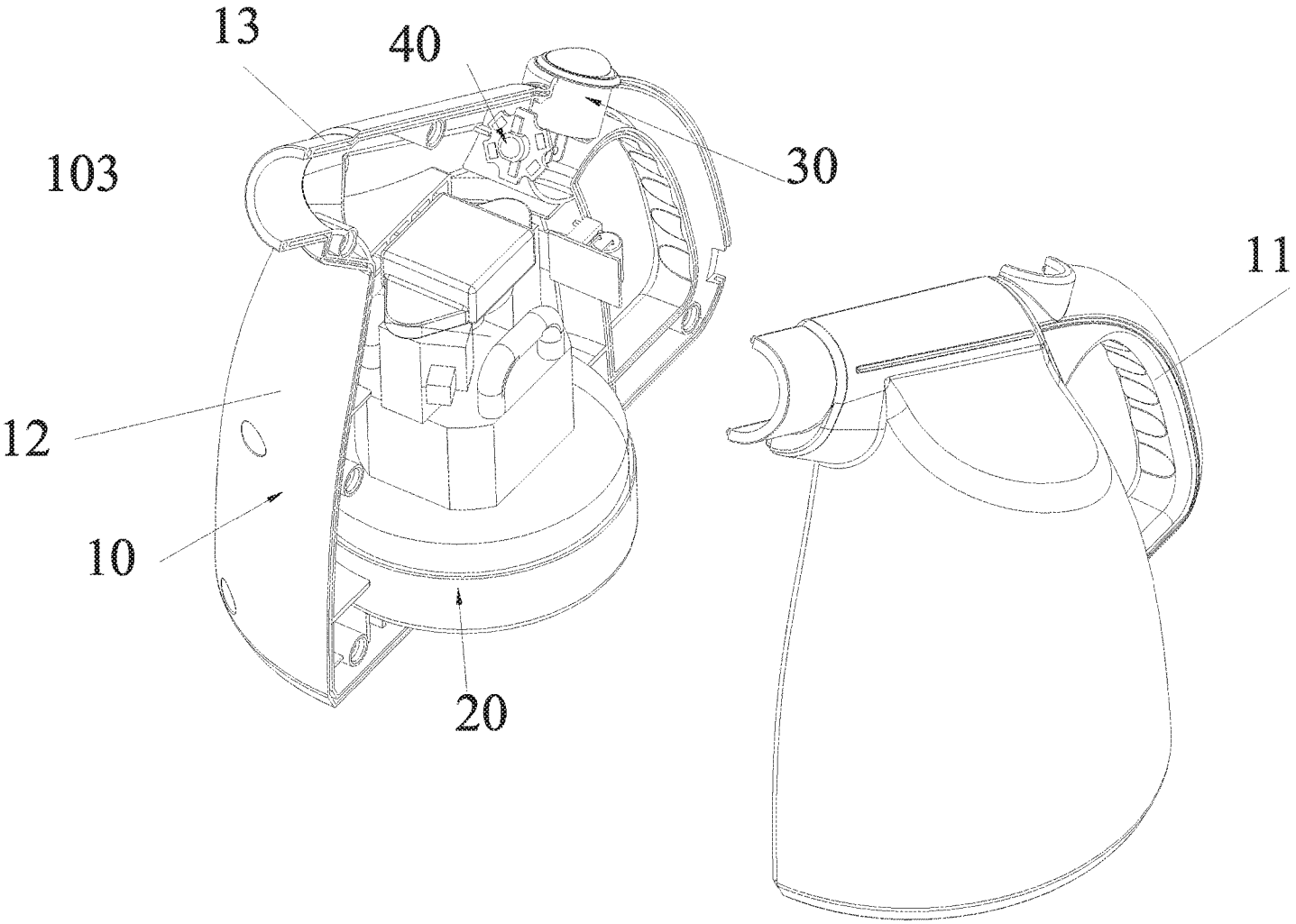
FIG. 3 is an exploded view according to one optional embodiment of the present disclosure.
Figure 4:
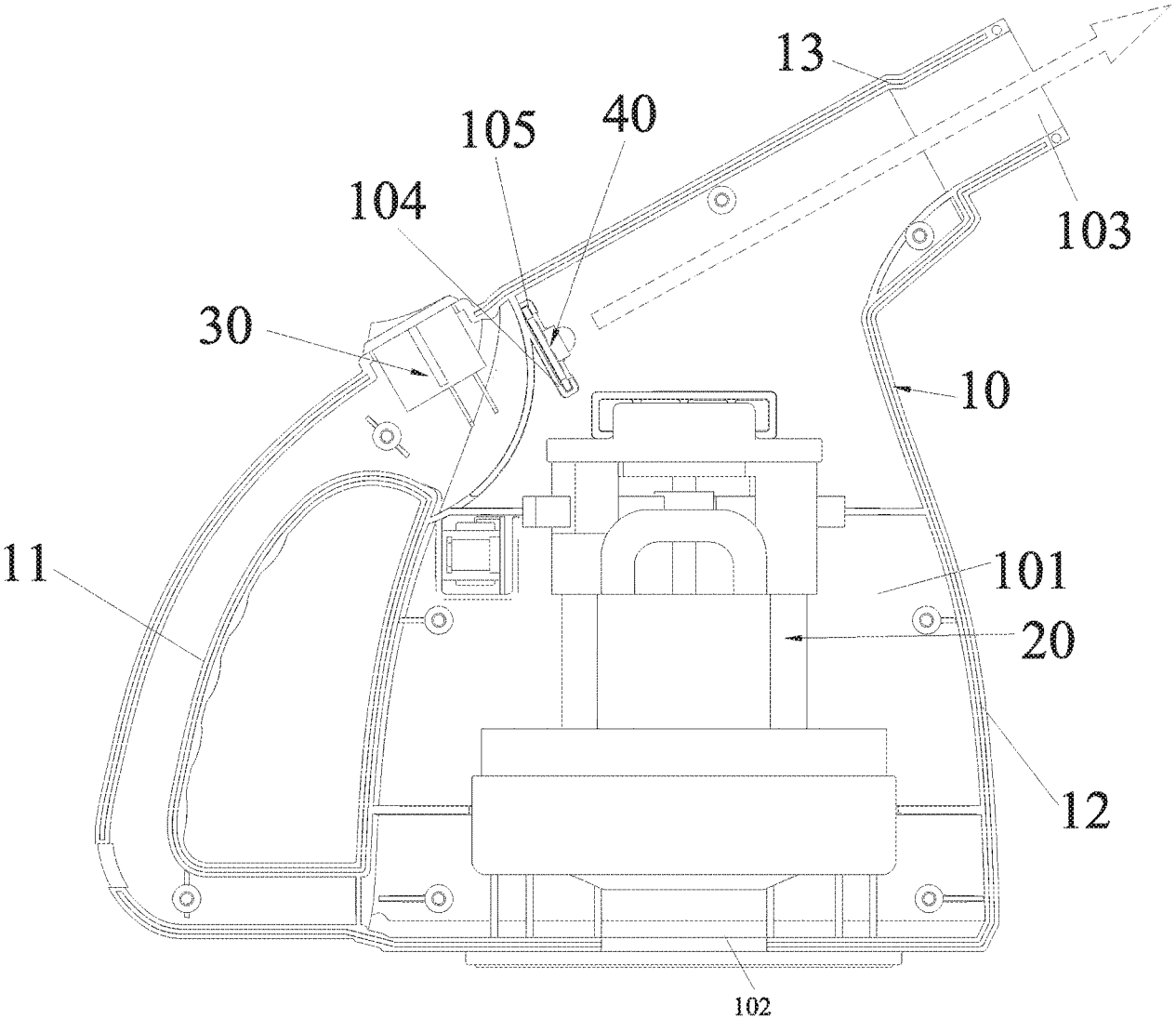
FIG. 4 is a cross-sectional view according to one optional embodiment of the present disclosure.

As shown in FIGS. 1-4, which show the specific structure of one optional embodiment of the present invention, the present disclosure comprises a housing 10 and a movement 20.

The housing 10 comprises an installation cavity 101, an air inlet 102, and an air outlet 103. The air inlet 102 and the air outlet 103 are communicated with the installation cavity 101. In the embodiment, the housing 10 is composed of a left shell and a right shell. An installation portion 104 is arranged in the installation cavity 101. The installation portion 104 comprises a clamping groove 105. The housing 10 comprises a handle 11. A control switch 30 is arranged on a front side of the handle 11. The housing 10 comprises a main body 12, and the handle 11 extends from a rear side of the main body 12. An air nozzle 13 extends forward and upward from a top portion of the main body 12. The air outlet 103 is arranged on a front end surface of the air nozzle 13. The air inlet 102 is arranged on a bottom surface of the main body 12.

The movement 20 is arranged in the installation cavity 101 and is arranged between the air inlet 102 and the air outlet 103. In the embodiment, the movement 20 is arranged in the main body 12. The movement 20 comprises a motor and blades driven by the motor.

An illuminating light 40 is arranged in the housing 10. The illuminating light 40 is arranged inside the installation cavity 101 and directly faces the air outlet 103. In the embodiment, the illuminating light 40 is an LED light board. The LED light board is clamped and fixed on the clamping groove 105. The illuminating light 40 and the movement 20 are electrically connected with the control switch 30.

The working principle of the blower cleaner of the present disclosure is as follow:

When in use, first, a power cord connected with the control switch 30 is connected with an external power source, and then, the handle 11 is held by a user and the control switch 30 is turned on. The movement 20 works after electrified to make the air entering from the air inlet 102 to form wind. blowing out from the air outlet 103 to blow dust on various items, such as an external computer case. Meanwhile, the illuminating light 40 is turned on after electrified, and the light generated by the illuminating light 40 emits from the air outlet 103 to illuminate the position where dust needs to be blown, which is convenient for the user to blow dust in positions with poor light.

By arranging the illuminating light in the housing and arranging the illuminating light in the installation cavity to directly face the air outlet, when the present disclosure is used, the light generated by the illuminating light emits from the air outlet to accurately illuminate the position to be blown, which is convenient for the user to find out position that needs to be blown and cleaned, so as to effectively blow and clean the items, therefore the user is no need to hold a flashlight and other lighting tools, which brings convenience to the user.

The above are only optional embodiments of the present disclosure, and do not intend to limit the scope of the present disclosure. Therefore, any minor modifications, equivalent changes and modifications that are made based on the technical essence of embodiments of the present disclosure should be fall within the scope of the present disclosure.

What is claimed is:

1. A blower cleaner, comprising a housing; and a movement;

wherein the housing comprises an installation cavity, an air inlet, and an air outlet; the air inlet and the air outlet are communicated with the installation cavity; the movement is arranged in the installation cavity and is arranged between the air inlet and the air outlet; wherein an illuminating light is arranged in the housing, and the illuminating light is arranged inside the installation cavity and directly faces the air outlet;

wherein the housing comprises a handle; the housing comprises a main body, the handle extends from a rear side of the main body, and an air nozzle extends forward and upward from a top portion of the main body; the air outlet is arranged on a front end surface of the air nozzle, the air inlet is arranged on a bottom surface of the main body; and the movement is arranged in the main body.

2. The blower cleaner according to claim 1, wherein an installation portion is arranged in the installation cavity; the installation portion comprises a clamping groove; the illuminating light is a light-emitting diode (LED) light board, and the LED light board is clamped and fixed on the clamping groove.

3. The blower cleaner according to claim 1, wherein a control switch is arranged on a front side of the handle; the illuminating light and the movement are electrically connected with the control switch.

* * * * *